US006053148A

United States Patent [19]

Glovatsky et al.

[11] Patent Number: 6,053,148

[45] Date of Patent: Apr. 25, 2000

[54] INTAKE MANIFOLD FOR AN INTERNAL COMBUSTION ENGINE

[75] Inventors: Andrew Zachary Glovatsky, Livonia; Jay DeAvis Baker, W. Bloomfield; Myron Lemecha, Dearborn; Mark Miller, Monroe, all of Mich.

[73] Assignee: Ford Motor Company, Dearborn, Mich.

[21] Appl. No.: 09/027,453

[22] Filed: Feb. 21, 1998

[51] Int. Cl.[7] ..... F02M 37/04

[52] U.S. Cl. ..... 123/470; 123/184.34

[58] Field of Search ..... 123/470, 456, 123/184.31, 184.34, 184.61

[56] References Cited

U.S. PATENT DOCUMENTS

| | | | |
|---|---|---|---|
| 3,930,483 | 1/1976 | Blisko et al. | 123/184.31 |
| 4,577,596 | 3/1986 | Senga | 123/184.31 |
| 4,844,036 | 7/1989 | Bassler et al. . | |
| 4,909,221 | 3/1990 | Heuser | 123/470 |
| 4,950,171 | 8/1990 | Muzslay . | |
| 5,003,933 | 4/1991 | Rush, II et al. . | |
| 5,086,743 | 2/1992 | Hickey . | |
| 5,111,794 | 5/1992 | DeGrace, Jr. . | |
| 5,129,834 | 7/1992 | Cranford . | |
| 5,131,857 | 7/1992 | Gmelin et al. . | |
| 5,178,115 | 1/1993 | Daly . | |
| 5,189,782 | 3/1993 | Hickey . | |
| 5,203,304 | 4/1993 | Hafner et al. . | |
| 5,209,204 | 5/1993 | Bodenhausen et al. . | |
| 5,211,149 | 5/1993 | DeGrace, Jr. . | |
| 5,226,391 | 7/1993 | Gras et al. . | |
| 5,238,415 | 8/1993 | Bittner et al. . | |
| 5,261,375 | 11/1993 | Rush, II et al. . | |
| 5,295,468 | 3/1994 | Blessing et al. . | |
| 5,347,969 | 9/1994 | Gmelin et al. . | |
| 5,357,931 | 10/1994 | Semence . | |
| 5,363,825 | 11/1994 | Becker . | |
| 5,419,297 | 5/1995 | Peterson et al. | 123/470 |
| 5,477,819 | 12/1995 | Kopec . | |
| 5,568,798 | 10/1996 | Lorraine . | |
| 5,598,824 | 2/1997 | Treusch et al. . | |
| 5,607,315 | 3/1997 | Bonnah, II et al. . | |
| 5,657,733 | 8/1997 | Dozier et al. | 123/470 |
| 5,682,859 | 11/1997 | Wakeman | 123/470 |
| 5,743,235 | 4/1998 | Lueder | 123/470 |

*Primary Examiner*—Thomas N. Moulis
*Attorney, Agent, or Firm*—Leslie C. Hodges

[57] ABSTRACT

There is disclosed herein an intake manifold for a port-injected internal combustion engine, comprising: a manifold body 10 having an interior plenum 12, and a runner 14 extending outward from the manifold body 10, wherein the runner 14 has a distal end 16 and a passage 18 therethrough in communication with the plenum 12. The distal end 16 of the runner 14 has a socket 20 therein into which an EFI 50 may be operatively mounted, and a first keying feature 22 formed therein for aligning the EFI in a first predetermined orientation when the EFI is engaged with the socket 20 and keying feature 22. The manifold may further include a second keying feature 42 formed in the runner end 16 for aligning a coil-on-plug spark plug ignition coil 80 in a second predetermined orientation when the coil 80 is engaged with the second keying feature 42. The manifold may also include a means 30 for electrically connecting a signal source to the injector 50 and/or coil 80, arranged such that the EFI/coil may each be mechanically and electrically engaged with the manifold and signal source in essentially a single step.

13 Claims, 4 Drawing Sheets

INTAKE MANIFOLD FOR AN INTERNAL COMBUSTION ENGINE

BACKGROUND OF THE INVENTION

1. Field of the Invention

The present invention relates generally to an intake manifold for an internal combustion engine, and more particularly for a port-fuel-injected internal combustion engine.

2. Disclosure Information

Conventional intake manifolds for internal combustion engines are typically constructed as shown in FIG. 1. Such manifolds include a body 10 having an interior plenum 12, and a plurality of runners 14 each extending outward from the body. Within each runner is a passage 18 therein in fluid communication at one end with the plenum and at another end 16 with an outlet port. When the manifold is fastened atop an engine, each outlet port is placed in communication with a respective engine cylinder port.

In electronic port fuel injected engines, an individual electronic fuel injector (EFI) 50 is provided for each cylinder port. In top-feed EFI systems, for instance, each EFI is typically installed into a sealable socket or well 20 in the manifold adjacent the EFI's associated cylinder port. The bottom end of the EFI sealably protrudes through the bottom of the manifold and into the cylinder port, while the top end is held in sealed communication with a fuel rail 70 which provides fuel to each EFI. The EFI typically has outwardly extending electrical contacts 52 to which a wire harness or cable is connected, through which electrical pulses may be transmitted from a signal source for actuation of the EFI (i.e., for causing the EFI to inject a given amount of fuel into its cylinder port). To provide the spark needed for combustion, a spark plug is positioned with its bottom (firing) end sealably exposed within the cylinder and its top end connected to one end of a wire/cable; the other end of this wire/cable may be attached to a coil-on-plug spark ignition coil 80, which in turn is also connected to a signal source.

Installation of each EFI/coil typically involves a first step of mounting the EFI into its socket/well 20 or attaching the coil to some bracket/clip/etc. on the manifold generally near the EFI. Second, an electrical connector portion of a cable/wire/etc. is electrically connected to each EFI and coil (or, more specifically, to the electrical contacts on each EFI/coil).

It would be desirable for manufacturability, time savings, and other reasons to be able to perform the mechanical and electrical connection steps for each EFI and/or coil in a single step.

SUMMARY OF THE INVENTION

The present invention overcomes the disadvantages of the prior art approaches by providing an intake manifold for a port-injected internal combustion engine, comprising:

a manifold body having an interior plenum, and a runner extending outward from the manifold body, wherein the runner has a distal end and a passage therethrough in communication with the plenum. The distal end of the runner has a socket therein into which an EFI may be operatively mounted, and a first keying feature formed therein for aligning the EFI in a first predetermined orientation when the EFI is engaged with the socket and keying feature. The manifold may further include a second keying feature formed in the runner end for aligning a coil-on-plug spark plug ignition coil in a second predetermined orientation when the coil is engaged with the second keying feature. The manifold may also include a means for electrically connecting a signal source to the injector and/or coil, arranged such that the EFI/coil may each be mechanically and electrically engaged with the manifold and signal source in essentially a single step.

It is an object and advantage that the present invention provides an intake manifold having one or more keying features integrated therein for operatively mounting and maintaining EFIs and/or coils in respective predetermined orientations with respect to each associated runner.

Another advantage is that the present invention may include means for connecting a signal source to each EFI and/or coil in such a way that mechanical engagement with the manifold and electrical engagement with the respective signal source(s) may be accomplished in a single step.

These and other advantages, features and objects of the invention will become apparent from the drawings, detailed description and claims which follow.

DETAILED DESCRIPTION OF THE PREFERRED EMBODIMENTS

Figure 1:
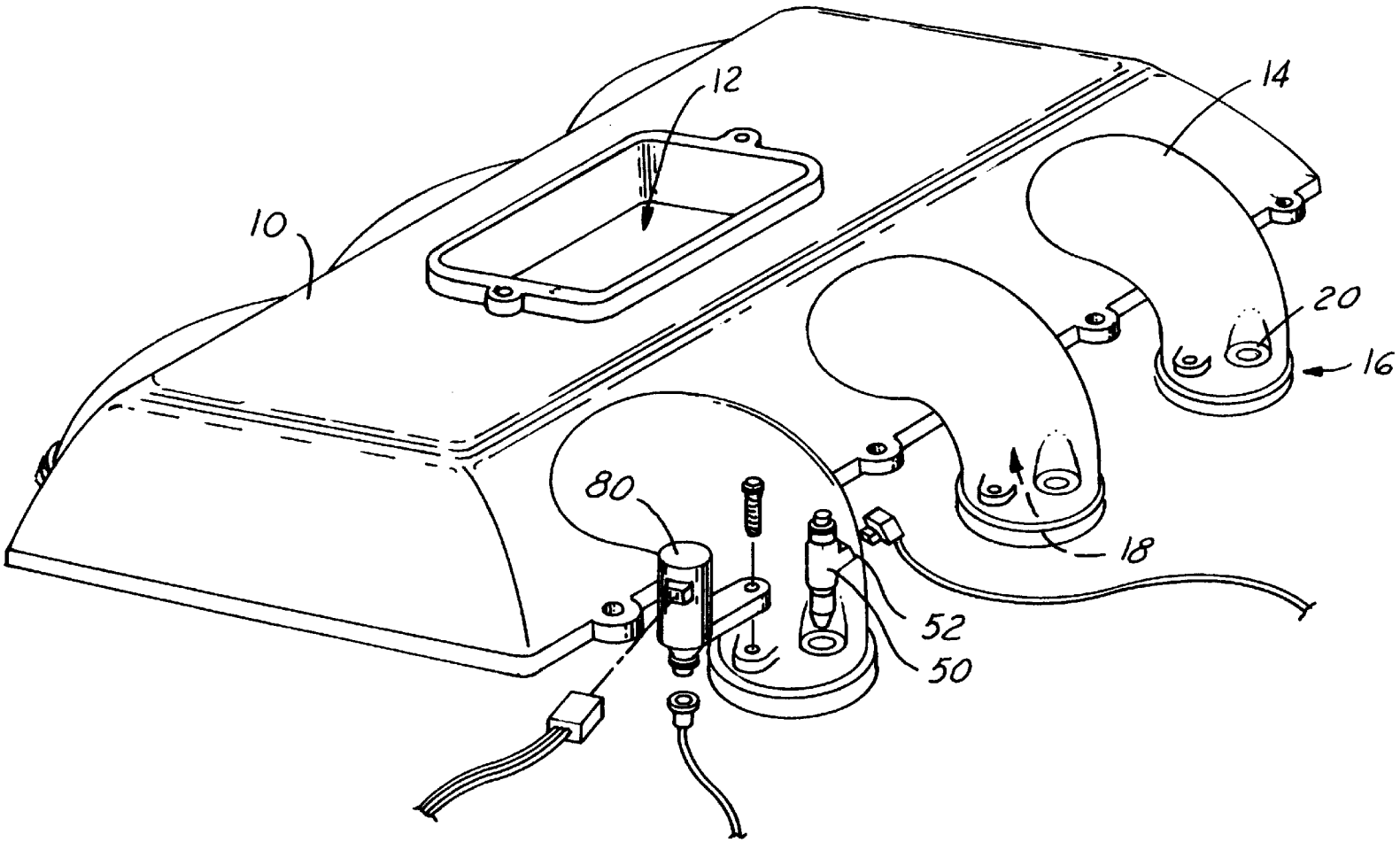
(PRIOR ART) FIG. 1
FIG. 1 is a perspective view of an engine and intake manifold according to the prior art.
Figure 2A:
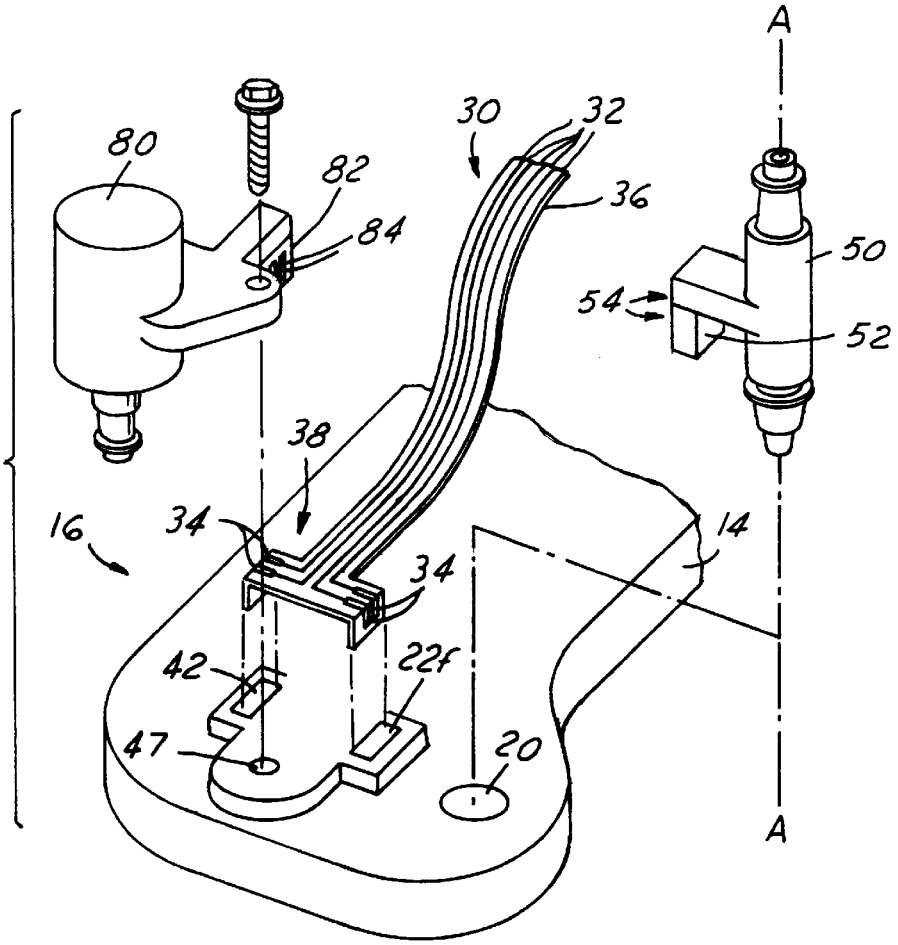
FIGS. 2A–B are exploded and assembled perspective views, respectively, of a first configuration of an intake manifold according to the present invention.
Figure 2B:
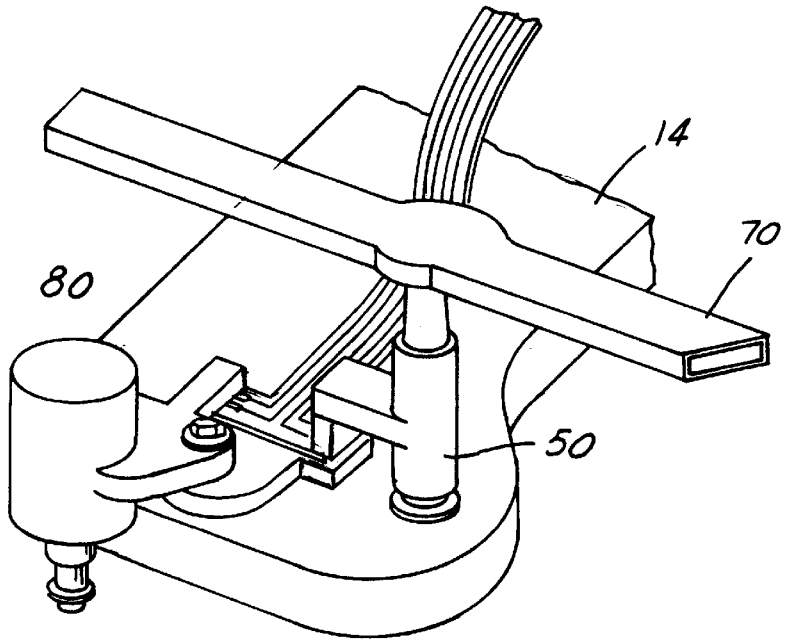
Figure 3A:
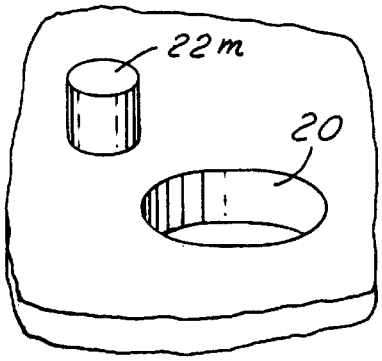
FIGS. 3A–3E are plan views of various keying feature configurations according to the present invention.
Figure 3B:
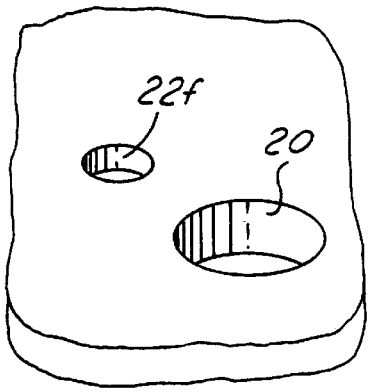
Figure 3C:
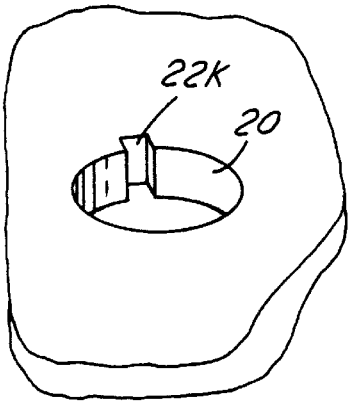
Figure 3D:
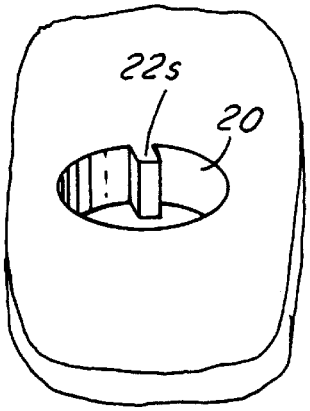
Figure 3E:
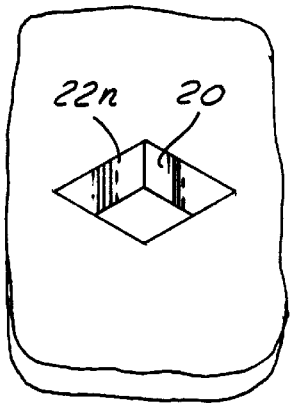

Referring now to the drawings, FIGS. 2A–2B show an intake manifold for a port-fuel-injected internal combustion engine according to the present invention. This embodiment comprises: a manifold body 10 having an interior plenum 12, and a runner 14 extending outward from the manifold body 10, wherein the runner 14 has a distal end 16 and a passage 18 therethrough in communication with the plenum 12. The distal end 16 of the runner 14 has a socket therein into which an EFI 50 may be operatively mounted, and a keying feature 22 formed in the runner 14 for aligning the EFI in a predetermined orientation when the EFI is engaged in the socket 20 and the keying feature 22.

While the manifold body 10 and runners 14 may each be individuated and made of metal, it is preferred that the body and runners be integrated into a single piece, as may be accomplished by die casting or, more preferably, by plastic injection molding. Also, while the socket 20 and keying feature 22 in the distal end of each runner may be milled or otherwise formed in the runner as a separate step subsequent to the molding of the manifold, it is preferred that the sockets 20 and keying features 22 be molded into their respective runners. This may be accommodated by appropriate construction of the manifold mold.

The keying feature 22 serves to align the EFI in a predetermined orientation when the EFI is placed in the socket 20. The predetermined orientation is generally a rotational position of the EFI about its longitudinal axis A—A, as indicated in FIGS. 2A–2B. While the predetermined orientation may vary from case to case, it will generally be such that the electrical contacts 54 of each EFI are presented so as to be easily connectable with each EFI's associated means for supplying electric activation signals thereto. This orientation may be such that the EFI's electrical contacts 54 are presented either (1) generally facing away ("outboard") from the manifold body, (2) generally facing inward ("inboard") toward the manifold body, or (3) somewhere in-between (i.e., facing generally alongside the manifold, either toward the front or rear thereof). Typically the first of these three orientations is preferred.

The socket 20 and keying feature 22 of each runner 14 are preferably arranged such that an EFI assumes its predetermined orientation by being placed into both its socket and keying feature essentially simultaneously.

Since the typical EFI is generally shaped as a solid of revolution, once an EFI is inserted into its usually round socket in a conventional intake manifold the EFI may be easily rotatable about its longitudinal axis A—A. In contrast, by including a keying feature 22 in the manifold runner as described herein, an EFI may be inserted into its socket 20 and keying feature 22 generally simultaneously so that the EFI assumes the desired predetermined orientation and is effectively prevented from rotation about its axis A—A.

The keying feature 22 may comprise one or more configurations, including: a male feature 22*m* disposed adjacent the socket; a female feature 22*f* disposed adjacent the socket; a keyslot 22*k* formed in a wall of the socket; a spline 22*s* formed in a wall of the socket; and a noncircular transverse profile 22*n* of the socket. These configurations are illustrated in FIGS. 3A–3E.

A male feature 22*m* may include a pin, peg, or other promontory onto which the EFI may engage. The male feature 22*m* may be made from the same material as the surrounding runner, in which case it may be an integral molded-in feature, or it may be made of metal, in which case it may be insert-molded during the molding of the manifold or placed/embedded therein in a post-molding operation. A female feature 22*f* may include a hole, pocket, detent, or other void into which the EFI may engage. Such a feature may be formed during molding or as a subsequent step.

A keyslot 22*k* may include a slot, channel, or other relief cut into a wall of the socket. The profile of such a keyslot 22*k* may be rectangular, rounded, or otherwise, and may extend either to essentially the entire depth of the socket or to only a portion of this depth. The keyslot 22*k* may be an essentially straight fluting or a spiraled rifling. Alternatively, rather than a keyslot, a spline 22*s* may be provided along a wall of the socket. Like the keyslot, the spline 22*s* may be of rectangular, rounded, or other profile, may extend either fully or partially along the depth of the socket wall, and may be straight or spiraled.

As mentioned above, a typical EFI is generally shaped as a solid of revolution, and thus a generally round socket generally conforming to the shape of the inserted portion of the EFI is typically provided in the manifold/runner. As an alternative, the socket 20 may be formed with a non-circular transverse profile, such as a rectangular, square, oblong, or other profile. By providing a mating, non-circular profile and an acceptably tight fit between the EFI and its socket, and by providing the socket profile in the runner in a given predetermined orientation, the EFI may be mounted in the desired orientation while being prevented from rotation.

With any of the aforementioned keying features 22, it is necessary that the EFI have a mating feature 52 which corresponds to and mates with the selected keying feature. For example, if a male keying feature 22*m* is used, the EFI must have a mating female feature, as illustrated in FIGS. 2A–B. Here, the mating feature 52 comprises a generally L-shaped arm extending outward and downward from the main body of the EFI. As another example, if a keyslot keying feature 22*k* is used in the socket wall, then the EFI must have a corresponding peg, spline, or other mating promontory thereon. It should also be apparent that the placement of both the keying feature 22 on the runner and the mating feature 52 on the EFI should be such that the EFI is presented in the desired predetermined orientation when finally mounted in its associated socket 20 and keying feature 22.

The intake manifold may further include means 30 for electrically connecting a signal source to the injector 50. This means 30 may comprise an electrically conductive path 32 coupled with an electrical connector 34.

The conductive path 32 may include one or more of a wire/cable, a stamping, a metallization, a circuit trace, and the like for conveying electrical signals from the signal source to the electrical connector 34. Each EFI will typically require two electrically conductive paths 32 coupling the signal source and the EFI's respective connector 34. For each EFI this may be provided by two discrete wire strands, a single dual-wire strand/cable, a single wire plus a metallization (such as a foil or sputtered ground plane), two discrete wire-like stampings (e.g., as part of a larger leadframe or bus), two metallic (e.g., copper) circuit traces, and so forth. The two paths 32 for each EFI may be (1) discrete/individuated, or may be (2) mechanically (but not electrically) attached to/combined with one another as in the case of common wire harness/ribbon cable/flex circuit arrangements.

Whether individuated or combined, it may be desirable to secure the paths 32 to the manifold by such means as: removably connecting/fastening them to the manifold/runner (e.g., with clips and/or threaded fasteners); applying/adhering them directly to the manifold/runner surface (e.g., by sputtering/plating circuit traces onto the manifold/runner surface, or adhering a flex circuit or ribbon cable with wires/circuit traces/conductive ink paths therein/thereon to the manifold/runner surface using an adhesive); embedding the paths atop/within/beneath the manifold/runner surface (e.g., by in-molding the paths into/onto the manifold/runner during injection molding thereof, or by post-molding ultrasonic embedding methods); and so forth.

The connector 34 may be custom-made or an off-the-shelf connector, but in either case it must be capable of complementary electrical connection with the contacts 54 of the EFI by engaging/mounting the EFI into its associated socket 20 and keying feature 22. For example, if the EFI has two male blade contacts 54, the electrical connector 34 must include two corresponding/complementary female receptacles for receiving the blade contacts 54.

The connector 34 may include one or more wiping contacts (i.e., the respective surfaces of the connector 34 and the EFI contacts 54 wipe or slide against each other during the mechanical insertion/connection process), one or more thrust contacts (i.e., the respective surfaces of the connector 34 and the EFI contacts 54 are pressed together in a direction generally orthogonal to their surfaces with no appreciable wiping therebetween), or a combination thereof.

The electrical connector 34 is preferably disposed adjacent at least one of the socket 20 and the keying feature 22, such that the connector 34 is operatively connected to the injector 50 (more specifically, to the injector contacts 54) by engaging the injector with the socket and keying feature essentially simultaneously. For example, as illustrated in FIGS. 2A–B, the conductive paths 32 may comprise wires/circuit traces/conductive ink paths/etc. carried on a flex circuit/ribbon cable 36, with the flex/ribbon carrier 36 draped on/attached to the runner 14. The electrical connector 34 in this case is a dual-ganged set of wiping contacts attached to the end of the flex/ribbon carrier with each contact electrically connected with a respective conductive path 32. The connector 34 is disposed along an interior wall within a female keying feature 22*f*. When the EFI 50 is engaged with and inserted into the socket 20 and keying feature 22*f* as shown, its contacts 54 will wipe along and maintain electrical contact with the electrical connector contacts 34. Thus engaged, the EFI is mechanically restrained from rotation about its longitudinal axis, and is maintained in electrical contact with the signal source via the signal connecting means 30. The fuel rail 70 may then be lowered into place atop the injectors 50 and fastened down, thus finally securing the EFI fully operatively into place.

The distal end 16 of the runner 14 may further include a second keying feature 42 formed therein for aligning a spark plug ignition coil 80 in a second predetermined orientation when the ignition coil 80 is mounted therein 42. (The second predetermined orientation has a definition similar to that for the EFI's predetermined orientation described above, but defined in terms of the coil rather than the EFI.) The runner end 16 may further include an optional locating feature 47 disposed adjacent the second keying feature 42, for fastening the coil 80 onto the runner end therewith and/or for assisting the second keying feature 42 in mounting the coil 80 onto the runner end 16 in the second predetermined orientation. These features 42/47 are illustrated in FIGS. 2A–B.

The second keying feature 42 may comprise a male feature (e.g., a pin, peg, or other promontory) or a female feature (e.g., a hole, pocket, or other relief) formed in the runner end 16. If it is desired that the coil 80 be installed so as to prevent rotation thereof, then it is preferable that the second keying feature 42 not be a round/circular male or female feature, unless it be accompanied by inclusion/use of the locating feature 47. Of course, the locating feature 47 may be included/used even if the second keying feature is not a round/circular male/female feature. The locating feature 47 itself may be a male or female feature; if a female feature, it may optionally be threaded so as to receive a threaded fastener therein for fastening the coil 80 to the runner end 16, or may be non-threaded so as to receive a peg, pin, or other mating male coil feature therein.

A preferred configuration for the present invention is illustrated in FIGS. 2A–B. Here, the first and second keying features 22/42 are each female features (shown here as being generally rectangular) formed adjacent to one another in the runner end. A signal connection means 30 is shown having respective conductive paths 32 and connectors 34 for both an EFI 50 and an ignition coil 80, with the connectors 34 each being disposed within a respective keying feature 22/42. These connectors 34 may be wiping contacts draped on or embedded/attached to a wall of each keying feature 22/42, or may be thrust/wiping contacts draped on or embedded/attached to the floor of each keying feature. The conductive paths 32 may be wire/traces/etc. carried on a flex substrate draped or attached onto the runner 14, or may be wires/stampings/etc. embedded/molded atop or beneath the runner surface.

FIGS. 2A–B also show an EFI 50 and a coil 80 specially designed to electrically and mechanically connect with the present preferred configuration. The EFI 50 includes a generally L-shaped arm extending outward and downward from the EFI main body. The tip 52 of the arm is shaped so as to engagingly mate with the first keying feature 22 when the EFI is engaged with both the keying feature 22 and the socket 20. Here, the EFI electrical contacts 54 mate with the electrical connector 34 and are disposed in the tip/mating feature 52 of the arm, so that when the EFI is mounted into its associated socket 20 and keying feature 22, the EFI is both (1) mechanically retained so as to prevent rotation of the EFI and (2) electrically connected to its associated signal connector 34. The coil 80 is shown having a flange extending out from the main coil body, with a male mating feature 82 extending downward from the flange. This mating feature 82 is shaped so as to engagingly mate with the second keying feature 42. The flange further includes a generally vertical hole therethrough through which the threaded portion of a threaded fastener may pass. Electrical contacts 84 are provided integral with the mating feature 82 in a downwardly facing orientation as shown (similar to the contacts 54 of the EFI). Thus, the coil 80 may be operatively mounted to the runner end 16 by engaging its mating feature 82 and associated contacts 84 with the second keying feature hole 42 and associated connector 34. By providing the vertical flange hole and threaded coil locating feature 47 such that they operatively align, a threaded fastener may be passed through the flange hole and screwed into the locating feature. With the keying feature/mating feature 42/82 and the contacts/connector 84/34 thus respectively engaged, the coil 80 is both (1) mechanically retained and (2) electrically connected to its associated signal connector 34. With the EFI and coil thus mounted, the fuel rail 70 may then be positioned and fastened so as to operatively engage each EFI, as shown in FIG. 2B.

An alternative configuration is illustrated in FIG. 4, where the electrical connector 34 and at least some portion of the conductive signal paths 32 are attached to a support member 36. The support member 36 is especially useful when the electrical contacts 54/84 of the EFI and/or coil face and engage in a generally upward direction as illustrated; thus, in such an arrangement, the electrical connector(s) 34 would be carried on/embedded within an underside surface of the support member 36 in a downwardly engageable orientation proximate and end 38 of the support member 36.

Figure 4A:
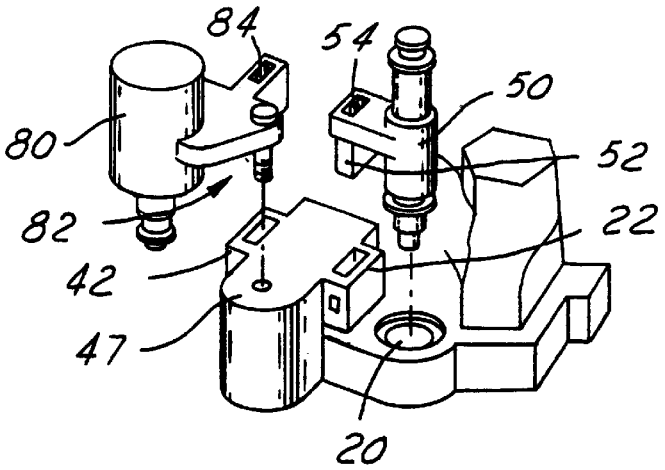
FIGS. 4A–4D are successive exploded and assembled perspective views of a second configuration of an intake manifold according to the present invention.
Figure 4B:
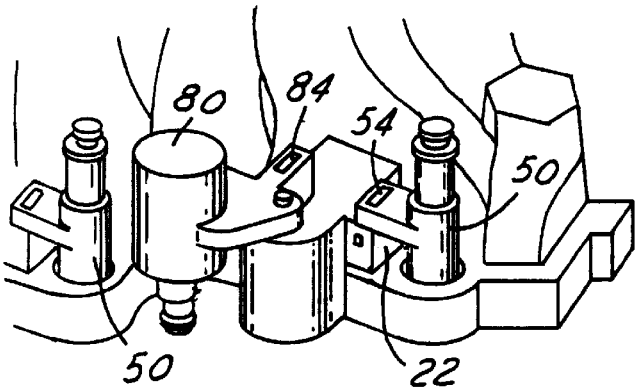
Figure 4C:
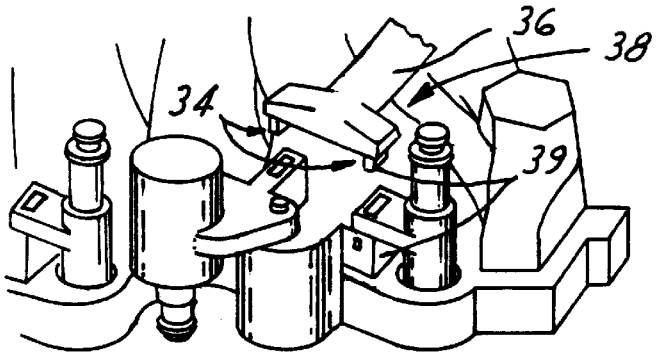
Figure 4D:
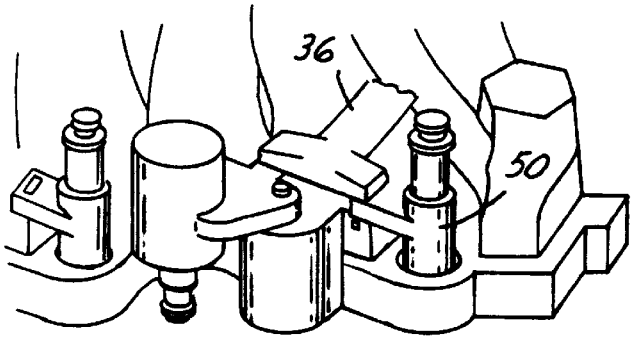

In the present configuration, the contacts 54/84 of the EFI/coil may be structurally integral with their respective mating features 52/82, but may not necessarily be functionally integral therewith; that is, whereas in the previous configurations both the mechanical location/orientation function and the electrical connection function are accomplished essentially simultaneously by engaging the EFI/coil with its respective keying feature (adjacent to which an electrical connector 34 is disposed/embedded), in the present alternative configuration the electrical connection function may be performed as a separate, subsequent step to the mechanical location/orientation function. The EFI/coil may each be mechanically engaged with its respective socket/keying feature as shown in FIG. 4B, after which the support member 36 may be positioned so as to mechanically and electrically engage the downwardly facing electrical connector(s) 34 with the respective upwardly facing EFI/coil contacts 54/84.

The support member 36 may further include one or more means 39 for removably fastening at least the end 38 of the support member to the distal end 16 of the runner. Such means may include threaded fasteners, snap-fit tabs or slots, clips, latches, and the like, and may be disposed on the support member and/or the runner.

Figure 5A:
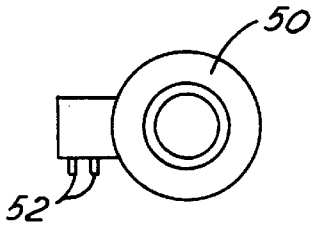
FIGS. 5A–5B are top and plan views, respectively, of an injector configuration compatible with an intake manifold according to the present invention.
Figure 5B:
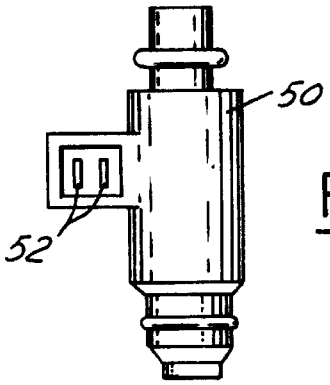

Various other modifications to the present invention will, no doubt, occur to those skilled in the art to which the present invention pertains. For example, although the manifold has been described as having only one runner 14 (for the sake of simplicity), most manifolds will have a plurality of runners, typically one per engine cylinder. Also, whereas most EFIs require two electrically conductive paths between itself and its associated signal source, it may not be required that both paths (or even either path) connect(s) directly (or even exclusively) with the signal source. For example, one of the paths may be a metallization or ground plane to which all of the EFIs (and possibly other components) directly connect, with this metallization/ground plane connecting only indirectly with the signal source. In such a case, only a single wire/conductor need be connected between the signal source and each EFI. Also, it should be apparent that the "signal source" as described herein may be a microprocessor and/or any other electrical/electronic component or sub-system which feeds electrical impulses to the EFIs and/or coils, causing the EFIs/coils to actuate (i.e., inject fuel or initiate spark) at specified times and durations. These impulses may be relatively low voltage/amperage "signals" (e.g., 150 millivolts) or relatively high voltage/amperage "power feeds" (e.g., 12 volts), depending upon the design of the EFIs. The"signal source" identified by reference numeral herein may constitute a single unit capable of activating the EFIs and/or the coils, or may be two or more separate units. Also, when the EFI is referred to as being "operatively mounted" in the socket 20, it will be understood that this means that the EFI is inserted into its associated socket/well in the manifold/runner so as to seat appropriately against the seals therein, thus being prepared to inject fuel into its associated engine cylinder port upon subsequent fuel rail attachment and electrical activation of the EFI. Furthermore, in addition to the configurations described in detail above, the present invention further includes configurations where an electrical connector 34 is attached to/embedded in the floor (as opposed to a wall) of a socket 20 or keying feature 22/42; in such cases, the EFI/coil may be inserted into its respective receptacle(s) with mechanical and electrical engagement being simultaneously accomplished rotating "twist-in" or non-rotating "plug-in" manner. Also, instead of the contacts 54/84 of the EFI/coil being either generally upwardly or downwardly facing/engaging, they may comprise a conductive ring or arc about some portion of the EFI/coil that is inserted into its associated receptacle (i.e., a socket or keying feature) with there being an appropriate connector 34 disposed within the receptacle, or the contacts 54/84 may face/engage in a direction generally tangential to the body of the EFI/coil as viewed along the direction of the longitudinal axis A—A, as illustrated in FIGS. 5A–B, with there being an appropriate connector 34 disposed within or adjacent to the receptacle. It is the following claims, including all equivalents, which define the scope of the present invention.

What is claimed is:

1. An intake manifold for a port-injected internal combustion engine, comprising:

a manifold body having an interior plenum;

a runner extending outward from said manifold body, wherein said runner has a distal end and a passage therethrough in communication with the plenum;

wherein said distal end of said runner has:

a socket therein into which an electronic fuel injector may be operatively mounted, and a keying feature formed therein for aligning the injector in a predetermined orientation when the injector is engaged with said socket and keying feature;

means for electrically connecting a signal source to the injector, wherein said means includes an electrically conductive path coupled with an electrical connector, wherein said electrical connector is disposed adjacent at least one of said socket and keying feature, such that said electrical connector is operatively connected to the injector by simultaneous engagement of the injector with said socket and said keying feature wherein said means for electrically connecting further includes a support member on which said electrical connector and at least some portion of said electrically conductive path are carried, wherein said electrical connector is disposed in a downwardly engageable orientation proximate an end of said support member; and wherein said support member includes means for removably fastening at least said end of said support member to said distal end of said runner.

2. An intake manifold according to claim 1, wherein said keying feature comprises at least one of:

a male feature disposed adjacent said socket;

a female feature disposed adjacent said socket;

a keyslot formed in a wall of said socket;

a spline formed in a wall of said socket; and a non-circular transverse profile of said socket.

3. An intake manifold according to claim 1, wherein said keying feature prevents the injector from rotation within said socket when the injector is mounted in both said socket and said keying feature.

4. An intake manifold according to claim 1, wherein said electrically conductive path is embedded atop or within said runner, and wherein said electrical connector is embedded adjacent at least one of said socket and said keying feature, such that said electrical connector is operatively connected to the injector by engaging the injector with said socket and said keying feature.

5. An intake manifold according to claim 1, wherein said means for electrically connecting is carried on or within an underside surface of said support member.

6. An intake manifold according to claim 1, wherein said manifold body and said runner are made of molded plastic.

7. An intake manifold according to claim 6, wherein said socket and said keying feature are molded into said runner.

8. An intake manifold for a port-injected internal combustion engine, comprising:

a manifold body having an interior plenum;

a runner extending outward from said manifold body, wherein said runner has a distal end and a passage therethrough in communication with the plenum;

wherein said distal end of said runner has:

a socket therein into which an electronic fuel injector may be operatively mounted, and a keying feature formed therein for aligning the injector in a predetermined orientation when the injector is engaged with said socket and said keying feature;

means for electrically connecting a signal source to the injector, wherein said means includes an electrically conductive path coupled with an electrical connector, wherein said electrical connector is disposed adjacent at least one of said socket and said keying feature, such that said electrical connector is operatively connected to the injector by simultaneous engagement of the injector with said socket and said keying feature; and a locating feature disposed in said distal end of said runner adjacent said keying feature, wherein said locating feature comprises a male feature or a female feature.

9. An intake manifold according to claim 8, wherein said second keying feature comprises at least one of:

a male feature disposed adjacent said socket;

a female feature disposed adjacent said socket;

a keyslot formed in a wall of said socket;

a spline formed in a wall of said socket; and a non-circular transverse profile of said socket.

10. An intake manifold according to claim 8, further including a locating feature disposed in said distal end of said runner adjacent said second keying feature, wherein said locating feature comprises a male feature or a female feature.

11. An intake manifold for a port-injected internal combustion engine, comprising:

a manifold body having an interior plenum;

a runner extending outward from said manifold body, wherein said runner has a distal end and a passage therethrough in communication with the plenum;

wherein said distal end of said runner has:

a socket therein into which an electronic fuel injector may be operatively mounted;

a first keying feature formed therein for aligning the injector in a first predetermined orientation when the injector is engaged with said socket and said first keying feature; and a second keying feature formed therein for aligning a spark plug ignition coil in a second predetermined orientation when the coil is engaged with said second keying feature;

wherein said first keying feature comprises at least one of a male feature disposed adjacent said socket, a female feature disposed adjacent said socket, a keyslot formed in a wall of said socket, a spline formed in a wall of said socket, and a non-circular transverse profile of said socket; and wherein said second keying feature comprises a male feature or a female feature disposed in said distal end of said runner.

12. An intake manifold according to claim 11, further comprising means for electrically connecting a signal source to the injector and coil, wherein said means includes a first electrically conductive path coupled with a first electrical connector and a second electrically conductive path coupled with a second electrical connector, wherein said first electrical connector is disposed adjacent at least one of said socket and said first keying feature such that said first electrical connector is operatively connected to the injector by engagement of the injector with said socket and said first keying feature, and wherein said second electrical connector is disposed adjacent said second keying feature such that said second electrical connector is operatively connected to the coil by engagement of the coil with said second keying feature.

13. An intake manifold according to claim 11, further comprising means for electrically connecting a signal source to the injector and coil, wherein said means includes a first electrically conductive path coupled with a first electrical connector and a second electrically conductive path coupled with a second electrical connector, wherein said means for electrically connecting further includes a support member on which said electrical connectors and at least some portion of said electrically conductive paths are carried, wherein said electrical connectors are disposed in a downwardly engageable orientation proximate an end of said support member.

* * * * *